United States Patent [19]

Lasagna et al.

[11] Patent Number: 4,799,471

[45] Date of Patent: Jan. 24, 1989

[54] ELECTRONIC SYSTEM FOR CONTROLLING THE IGNITION OF AN INTERNAL COMBUSTION ENGINE, PARTICULARLY FOR MOTOR VEHICLES

[75] Inventors: Diego Lasagna, Chieri; Francesco P. Mandara, Turin, both of Italy

[73] Assignee: Marelli Autronica S.p.A., Milan, Italy

[21] Appl. No.: 160,875

[22] Filed: Feb. 26, 1988

[30] Foreign Application Priority Data

Feb. 26, 1987 [IT] Italy ..... 67137-A/87

[51] Int. Cl.[4] ..... F02P 1/00

[52] U.S. Cl. ..... 123/644; 123/623; 123/617; 123/611

[58] Field of Search ..... 123/644, 623, 611, 617

[56] References Cited

U.S. PATENT DOCUMENTS

| | | | |
|---|---|---|---|
| 4,492,213 | 1/1985 | Yamamoto et al. | 123/644 |
| 4,694,814 | 9/1987 | Gademann et al. | 123/644 |
| 4,709,684 | 12/1987 | Kaiser et al. | 123/644 |
| 4,711,226 | 12/1987 | Naubalfan et al. | 123/644 |
| 4,739,743 | 4/1988 | Iwata | 123/644 |
| 4,750,467 | 6/1988 | Naubalfan et al. | 123/644 |

*Primary Examiner*—Raymond A. Nelli

*Attorney, Agent, or Firm*—Sughrue, Mion, Zinn, Macpeak & Seas

[57] ABSTRACT

A control circuit which includes a circuit for regulating the time taken to desaturate the switching transistor. This regulating circuit is arranged to control the time for which the transistor is conductive, so that the desaturation time of the transistor is substantially nil when the rate of rotation of the engine is greater than a predetermined value.

3 Claims, 3 Drawing Sheets

Figure 1:
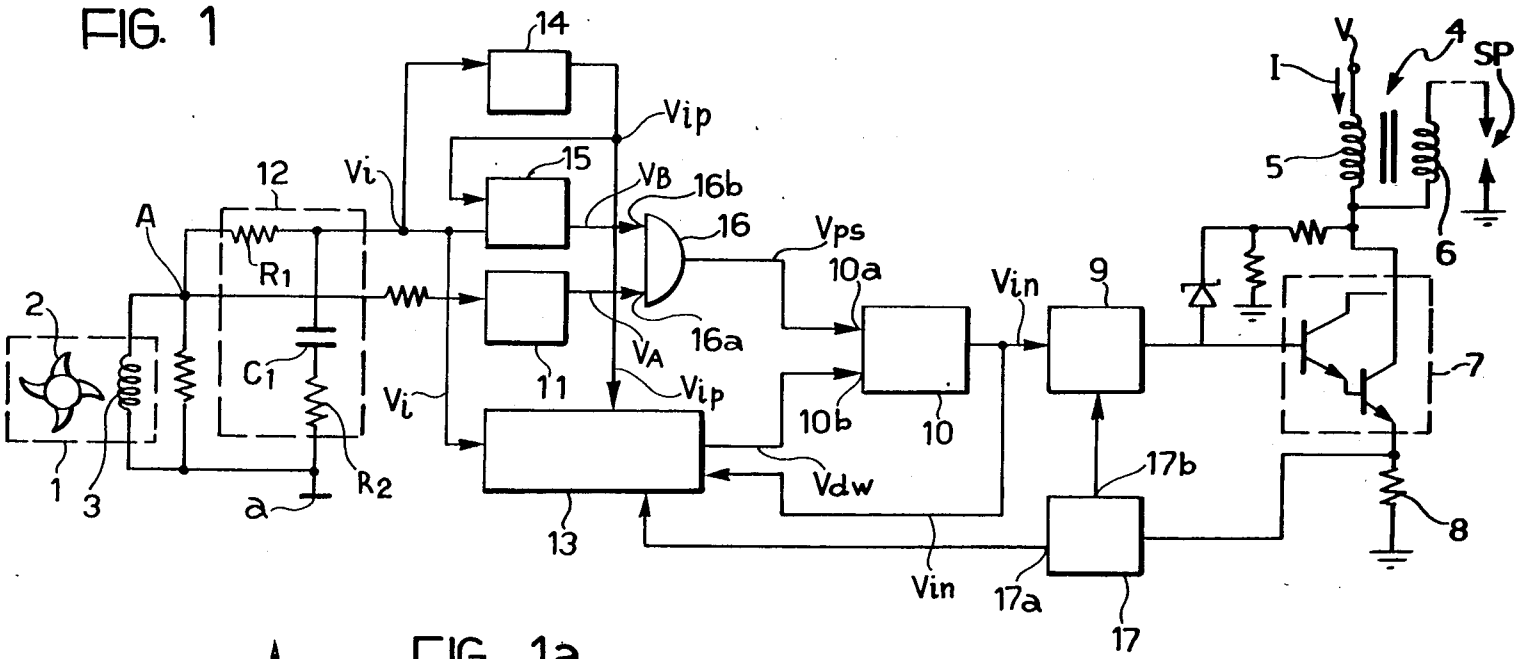

ELECTRONIC SYSTEM FOR CONTROLLING THE IGNITION OF AN INTERNAL COMBUSTION ENGINE, PARTICULARLY FOR MOTOR VEHICLES

DESCRIPTION

The present invention relates to an electronic system for controlling the ignition of an internal combustion engine, specifically a system comprising:

a magnetic pulse generator for outputting a signal having a frequency and amplitude proportional to the rate of rotation of the engine, an ignition coil the secondary winding of which can be coupled selectively and cyclically to the plugs of the engine to generate the spark, a switching transistor connected to the primary winding of the coil, and an control circuit which is connected to the pulse generator and to the switching transistor and which, in order to cause a spark to be generated, is arranged to cause a. the transistor to become saturated at a first moment determined by the characteristics of the signal from the pulse generator to allow current to pass through the primary winding of the ignition coil, b. the transistor to be desaturated immediately the current has reached a predetermined value in order to limit the intensity of the current, and c. the transistor to be cut off at a second moment determined by the characteristics of the signal from the pulse generator to interrupt the current.

In electronic ignition control systems of this type made up till now, the switching transistor is generally of the Darlington type. The primary winding of the ignition coil typically also has a very low resistance to allow the current circulating in it to rise rapidly when the switching transistor is saturated. This is due to the fact that it is necessary to allow the current in the primary winding of the ignition coil to reach a sufficiently high value even when the battery is running down.

At low rates of rotation of the engine, the current in the primary winding of the coil can thus even reach very high values which could damage it. For this reason, the switching transistor is desaturated, that is, returned to linear operating conditions, immediately the current in the ignition coil has reached a predetermined limit, for example about 6A.

When the switching transistor is saturated, the current in the ignition coil increases exponentially with an almost linear initial trace. When the current reaches the predetermined final value, the transistor is desaturated and remains in this condition until it is cut off, interrupting the current sharply, in order to cause sparking. The time interval for which the transistor is kept desaturated is such as to enable the current in the ignition coil to reach a sufficient magnitude in various dynamic operating conditions, for example, even when the rate of rotation of the engine is increased sharply. In fact, the increase in the rate of rotation of the engine causes a reduction in the time between two successive sparks and hence a reduction in the time available to bring the current in the primary winding of the ignition coil to a magnitude sufficient to cause to the discharge.

When the switching transistor is saturated, it dissipates a small power since the value $V_{ce}$ is very small. However, the energy dissipated by the transistor is considerable when it operates in desaturated conditions, since the collector current and $V_{ce}$ both assume high values.

The object of the present invention is to provide an electronic ignition control system of the type mentioned above, which enables the dissipation of energy by the switching transistor to be reduced noticeably.

This object is achieved according to the invention by means of an electronic ignition control system of the type specified above, the main characteristic of which lies in the fact that the control circuit includes:

electrical sensor means for providing a signal indicative of the rate of rotation of the engine, and a circuit for regulating the desaturation time of the transistor, coupled to the electrical sensor means and arranged to control the time for which the switching transistor is conductive so that the length of the desaturation time of the transistor is substantially nil when the rate of rotation of the engine is greater than the predetermined value.

Figure 1A:
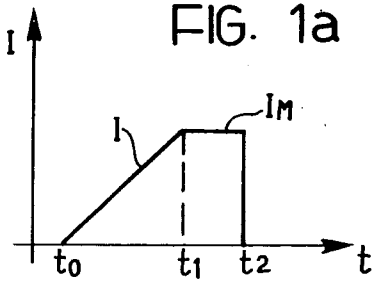
Figure 3:
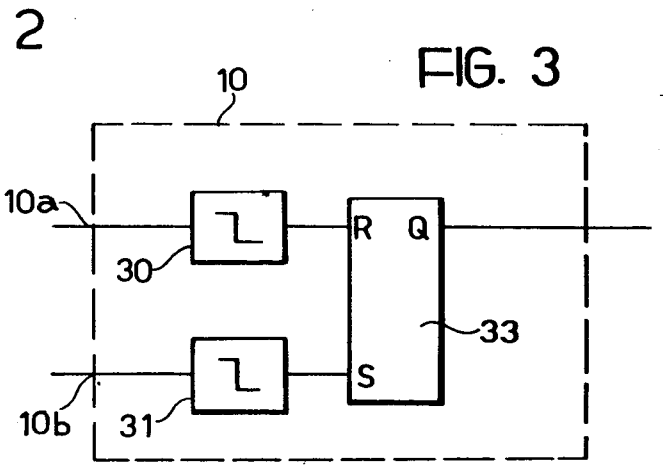
Figure 6:
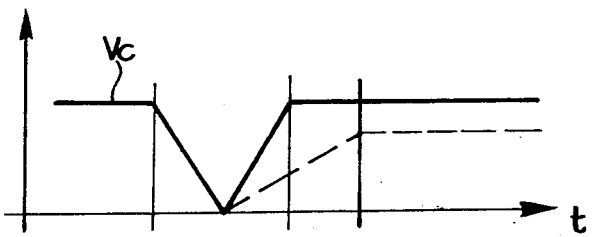
Figure 2:
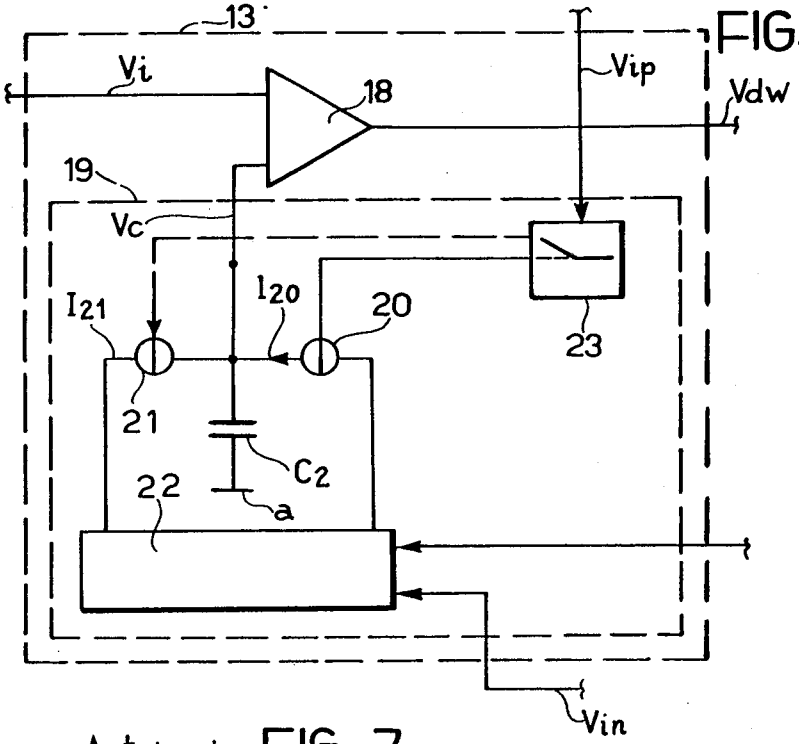
Figure 7:
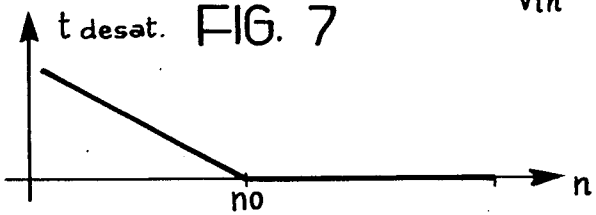
Figure 4:
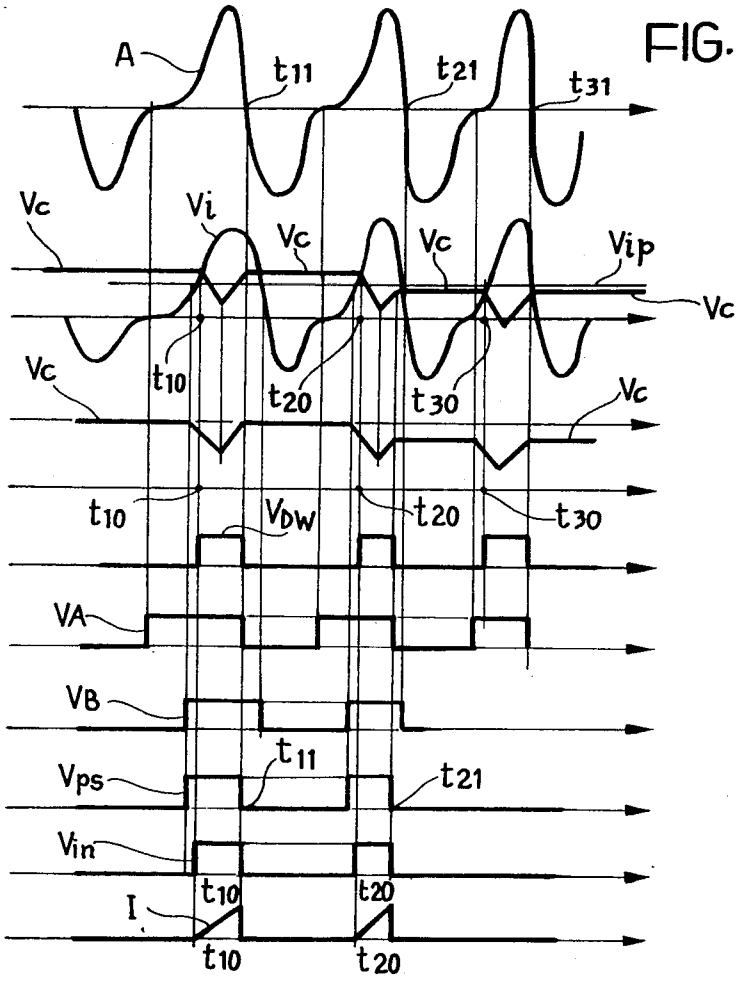
Figure 5:
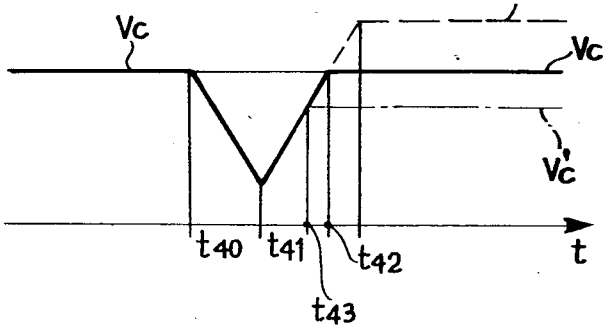

Further characteristics and advantages of the system according to the invention will become apparent from the detailed description which follows with reference to the appended drawings, provided purely by way of non-limiting example, in which:

FIG. 1 is a block diagram of an ignition control system according to the present invention, FIG. 1*a* shows possible change in the collector current of the switching transistor with time, FIGS. 2 and 3 are circuit diagrams illustrating the internal structure of two circuits forming part of the system of FIG. 1, FIG. 4 is a series of diagrams showing waveforms of signals generated in the system of FIG. 1, FIGS. 5 and 6 show possible changes in the signal generated in the system of FIG. 1, and FIG. 7 is a diagram showing the laws of variation of the desaturation time of the switching transistor as a function of the rate of rotation of the engine in the system of the invention.

With reference to FIG. 1, an electronic ignition control system according to the invention, for internal combustion engines, includes a magnetic pulse generator 1 including, in known manner, a toothed rotor 2 rotated by the engine, and a stationary inductive receiver (pick-up) 3. The pulse generator 1 is mounted in known manner, for example, within the body of the ignition distributor (not illustrated).

The pick-up 3 may, for example, include a coil of conductive wire located in a magnetic circuit with a variable gap. During rotation, each time a tooth of the rotor 2 passes in front of the coil 3 the flux in the magnetic circuit varies and, by induction, generates an electrical signal at the ends of the coil 3. The waveform of the signal generated by the pulse generator is, for example, that indicated A in FIG. 4. The form of this signal depends on the geometry of the rotor but, in general, the signal includes a portion with a positive amplitude in the phase in which a tooth approaches a pick-up 3, a nil amplitude (passage through zero) when a tooth faces the pick-up, and a negative portion corresponding to the phase in which the tooth moves away from the pick-up.

In other words, the signal output by the pick-up is proportional to the variation in the magnetic flux with time and its amplitude is therefore proportional to the rate of rotation (number of revolutions) of the engine, and the negative passages through zero are proportional to the frequency and precisely identify a particular position of the engine shaft.

With reference again to FIG. 1, the ignition control system includes, in known manner, an ignition coil or transformer 4 with a primary winding 5 and a secondary winding 6. The winding 5 is connected between a source of d.c. voltage V (a motor vehicle battery) and the collector of a power switching transistor 7 of Darlington type. A feedback resistor 8 for controlling the current in the winding 4 is connected between the emitter of this transistor and earth.

The secondary winding 6 of the transformer 4 can be connected to the plugs SP of the engine selectively and cyclically, for example, through a rotary distributor of known type.

The base of the transistor 7 is connected to the output of a pilot (driver) circuit 9 having its input connected to the output of a logic control circuit 10.

The pulse generator 1 is connected to the input of a passage-through-zero monitor 11 of known type.

In ignition control systems of known type, the current in the primary winding 5 of the ignition coil is controlled through a switching transistor 7 so that, for any rotational speed of the engine, it has a trace of the type shown by the waveform I in FIG. 1*a*. In order to achieve this current trace, in known systems, the signal A output by the pulse generator is compared with the value of a reference signal processed by an angle advance control circuit. When the signal A passes through the level of the reference signal, the switching transistor 7 is changed from the cut-off condition to the saturated condition, so that the current starts to increase practically linearly (instant $T_0$ in FIG. 1*a*) in the primary winding 5 of the ignition coil. The instantaneous value of the current in the primary winding of the ignition coil is controlled by means of the feedback resistor connected in the collector-emitter circuit of the switching transistor. In present ignition control systems, the current in the primary winding of the ignition coil 4 is limited to a maximum value, indicated $I_M$ in FIG. 1*a*, for example equal to 6A, to avoid damage to the primary winding of the ignition coil and to the Darlington transistor itself. This current limitation is, for the most part, obtained by a reduction in the base current of the Darlington transistor 7, so as to bring the latter from the saturated condition to a condition of operation in the linear zone (desaturation).

In known systems (and also in the system of the invention) immediately the pulse generator signal A presents a negative passage through zero (that is, a passage through zero in which a previously positive signal becomes negative), the switching Darlington transistor is cut off and the current in the primary winding of the ignition coil is interrupted suddenly (instant $T_2$ in FIG. 1*a*). Consequently, a high voltage sufficient to cause sparking is applied to the plug or plugs connected to the ignition coil at that moment.

The time interval between the instants $t_1$ and $t_2$ in FIG. 1*a* represents the so-called desaturation time of the transistor 7. The power dissipated by the transistor is very considerable in this period of time.

The electronic ignition control systems made up to now are arranged to control the switching transistor so that it has a specific desaturation time whatever the rate of rotation of the engine. This desaturtion time of the transistor is provided, among other things, to allow the current to reach a sufficient magnitude in the primary winding of the ignition coil even with sharp variations in critical parameters for the ignition, for example, when the rate of rotation of the engine increases sharply and hence the time available to bring the current in the ignition coil to the desired level is reduced.

With reference again to FIG. 1, in the control system of the present invention, a signal processing circuit, indicated 12, is connected to the output of the magnetic pulse generator 1. This circuit is arranged to output a signal, indicated $V_i$ in FIGS. 1 and 4, which corresponds substantially to the sum of a first signal proportional to the signal A of the pulse generator 1 and a second signal substantially proportional to the integral of the signal from the pulse generator. FIG. 1 illustrates a particularly simple and convenient embodiment of the signal processing circuit 12. In this embodiment, the circuit includes a resistor $R_1$ connected to the pick-up 3 of the magnetic pulse generator, and a capacitor $C_1$ and a resistor $R_2$ connected in series between the other terminal of $R_1$ and a terminal a maintained at a constant reference potential. The common terminal of the capacitor $C_1$ and the resistor $R_1$ is also the output of the processing circuit 12.

The signal $V_i$ output by the processing circuit 12 is applied to an input of a dwell angle control circuit 13, to the input of a peak monitor 14 and to a threshold comparator circuit 15.

A possible structure of the dwell angle control circuit 13 is illustrated in greater detail in FIG. 2.

The peak monitor 14 outputs a signal $V_p$ (FIGS. 1 and 4) the amplitude of which is indicative of the frequency of the signal $V_i$ and hence substantially of the frequency of the signal A, and therefore of the rate of rotation of the engine. This signal is used as a threshold reference signal for the comparator circuit 15.

A possible structure of the dwell angle control circuit 13 is illustrated in greater detail in FIG. 2.

The peak monitor 14 outputs a signal $V_p$ (FIGS. 1 and 4), the amplitude of which is indicative of the frequency of the signal $V_i$ and hence substantially of the frequency of the signal A, and therefore of the rate of rotation of the engine. This signal is used as a threshold reference signal for the comparator circuit 15.

The passage-through-zero monitor 11 is connected to the first input 16*a* of an AND gate 16 having another input 16*b* connected to the output of the threshold comparator 15. The output of the AND gate 16 is connected to a first input 10*a* of the logic control circuit 10. The other input 10*b* of this circuit is connected to the output of the dwell angle control circuit 13. This latter circuit is also connected to the output of the peak monitor 14, the output of the AND gate 16, and a first output 17*a* of a comparator circuit 17 having its input connected to the unearthed terminal of the feedback resistor 8.

The logic circuit 10 has its output connected to the input of the driver circuit 9 and to the dwell angle control circuit 13. The circuit 9 is also connected to a second output 17*b* of the comparator circuit 17.

This comparator circuit outputs a signal at its output 17*a* when the voltage across the ends of the resistor 8 indicates that the current I in the primary winding of the ignition coil has exceeded a predetermined value less than the value which is sufficient to trigger sparking. This value may be 3A, for example. The circuit 17 outputs a second signal at the output 17*b* when, on the other hand, the current I reaches the maximum predetermined value, for example 6A. For this purpose, the circuit 17 may simply include two threshold comparators.

In the ignition control system of FIG. 1, the signal $V_i$ output by the processing circuit 12 is used to determine the instants at which the primary winding of the ignition coil starts to conduct current. As already stated, this signal is proportional to the magnetic flux linkage in the pulse generator and is "cleaner" than the signal A from the pulse generator, in that the integration eliminates noise with an average zero value, and also has a decidely smaller dynamic as the frequency, that is, the rate of rotation of the engine, varies.

The instants at which current conduction is initiated are determined in the dwell angle control circuit 13 which is illustrated in greater detail in FIG. 2. This circuit includes a comparator 18 having one input connected to the output of the processing circuit 12 and a second input connected to a reference voltage generator circuit, generally indicated 19. The latter circuit includes a capacitor $C_2$ connected between an input of the comparator 18 and a terminal a kept at a reference voltage. Two current generators 20 and 21 are connected to this capacitor. When activated, the first generates a current $I_{20}$ which tends to charge the capacitor $C_2$. When activated, the generator 21 allows the capacitor to discharge.

A logic control circuit, indicated 22, controls the activation of the current generators 20 and 21. Reference 23 indicates a circuit for controlling the intensity of the current generator by the generators 20 and 21.

The logic circuit 22 has two inputs connected to the output 17*a* of the comparator circuit 17 and to the output of the logic circuit 10. The circuit 23, however, is connected to the output of the peak monitor 14.

As apparent from FIG. 3, the logic circuits 10 may include two mono-stable circuits 30 and 31 connected to the inputs 10*a* and 10*b* and arranged to generate a pulse of predetermined duration when they detect a descending trace and a rising trace respectively in the respective signals supplied to them. The outputs of the mono-stable circuits 30 and 31 are connected respectively to the reset and set inputs respectively of a bi-stable circuit (flip-flop) 33.

As is immediately understood, the logic circuit 10 outputs a signal $V_{in}$ (FIGS. 1 and 4) which has a rising trace for each rising trace of the signal $V_{dw}$ and a descending trace for each descending trace of the signal $V_{ps}$.

The circuit 22 of the dwell circuit 13 is arranged to activate the current generator 21 when the signal output by the comparator 18 indicates that the signal $V_i$ has exceeded the voltage $V_c$ localised at the capacitor $C_2$ (as occurs, for example, at the instants $t_{10}$, $t_{20}$, $t_{30}$ in FIG. 4 and at the instant indicated $t_{40}$ in FIG. 5). When this occurs, the current generator 21 causes partial discharging of the capacitor $C_2$ at constant current. The voltage $V_c$ across the capacitor thus decreases linearly, as illustrated in FIGS. 4 and 5.

As will become more apparent below, when the signal $V_i$ exceeds the voltage $V_c$, the switching transistor 7 is made to change from the cut off condition to the saturated condition and the current I in the primary winding of the ignition coil starts to increase almost linearly. Immediately this current reaches the lower threshold of the comparator circuit 17 (equal to 3A in the embodiment given previously), the logic control circuit 22 de-activates the current generator 21 and activates the current generator 20. This occurs, for example, at the instant indicated $t_{41}$ in FIG. 5.

Starting from this instant, the current generator 20 causes the capacitor $C_2$ to be recharged with a constant current and the voltage $V_c$ starts to increase linearly, as indicated in FIGS. 4 and 5.

The recharging phase of the capacitor $C_2$ is interrupted when the signal A from the pulse generator 1 passes through zero in the negative sense (instant of sparking), as occurs, for example, at the instants $t_{11}$, $t_{21}$, $t_{31}$ in FIG. 4 and at the instant $t_{42}$ in FIG. 5.

As stated previously, the instants at which current starts to flow in the primary winding of the ignition transformer correspond to the instants at which the trace of the signal $V_i$ intersects and rises through the voltage $V_c$. If the engine is running at a constant rate of rotation and the currents $I_{20}$ and $I_{21}$ are equal to each other, this voltage $V_c$, after a discharge-charging phase of the capacitor $C_2$, has the same level that it had before the discharge-charging phase, as indicated by the right-hand branch of $V_c$ shown in full outline in FIG. 5. When the rate of rotation of the engine increases suddenly, however, the signal A from the pulse generator increases in frequency and the negative passage through zero of the signal A is advanced. Consequently, the recharging phase of the capacitor $C_2$ is interrupted before time, for example, at the instant indicated $t_{43}$ in FIG. 5, and the voltage across the capacitor $V_2$ at the end of the charging pulse assumes a level, indicated $V'_c$ in FIG. 5, which is less than the level before the discharge-charging phase. Consequently, the subsequent intersection of the signal $V_i$ and the voltage across the capacitor is also advanced. Thus, the instant at which the primary winding of the ignition coil starts to conduct is also advanced correspondingly. This advance enables the desired value of the current in the coil to be achieved at the moment of discharge.

On the contrary, when the engine slows, the final voltage at the end of a discharge-charging phase of the capacitor $C_2$ will be higher than the initial value, as indicated, for example, by the level $V''_c$ in FIG. 5. Consequently, the intersection of the trace of the signal $V_i$ and the voltage across the capacitor is delayed and the instant at which the primary winding of the ignition coil starts to conduct current is therefore delayed.

The dwell angle control circuit thus enables a self-adapting type of control of the initiation of the conduction of current by the ignition coil to be achieved: if the rate of rotation of the engine increases this instant of initiation is gradually advanced, while if the engine slows it is retarded.

The signal output by the comparator 18 is indicated $V_{dw}$ in FIGS. 1 and 4. In the same Figures, $V_A$ and $V_B$ indicate the signals output by the passage-through-zero monitor 11 and by the comparator 15. Reference $V_{ps}$ indicates the signal output by the AND circuit 16. This signal has a descending trace (FIG. 4) in correspondence with each negative passage through zero of the signal A of the magnetic pulse generator 1. The comparator circuit 15 and the AND circuit 16 have the function of eliminating pulsed interference which may possibly "pollute" the signal A supplied by the pulse generator 1, essentially in accordance with the technique described in Italian patent application No. 67560-A/84 in the name of the same Applicants.

The inputs 10*b* and 10*a* of the logic circuit 10 are thus supplied with the signals $V_{dw}$ and $V_{ps}$ which define respectively the instants of initiation and the instants of cut off of the conduction of current by the primary winding 5 of the ignition coil 4.

The driver circuit 9 causes the Darlington switching transistor 7 to be conductive for the duration of each pulse of the signal $V_{in}$. Consequently, the current I in the ignition coil takes the form indicated I in FIG. 4.

The control system according to the invention is arranged to drive the switching transistor 7 so that the desaturation time of this transistor obeys, in dependence on the rate of rotation n of the engine, a law of variation which is essentially of the type illustrated in FIG. 7. As shown in this Figure, the desaturation time $t_{desat}$ decreases when the rate of rotation is less than the predetermined value $n_0$ (for example 3000 rpm) and is substantially zero when n is $n_0$.

In order to achieve this law of variation of the desaturation time, the dwell angle control circuit 13 includes the regulating circuit 23 which can change the intensity of the current generated by the generator 20 (and possibly also the generator 21) in dependence on the amplitude of the signal $V_{ip}$. The amplitude of the signal is, as stated above, indicative of the rate of rotation of the engine. More particularly, the regulating circuit 23 is arranged to reduce the current $I_{20}$ from the generator 20 when the signal $V_{ip}$ indicates that the rate of rotation of the engine is less than $n_0$, so that, in the phase in which the capacitor $C_2$ is recharged, the voltage $V_c$ increases more slowly, with a rate of increase which depends, in the final analysis, on the rate of rotation of the engine. The overall saturation and de-saturation conduction time of the switching transistor is therefore extended. Thus, the current in the coil may easily reach the prefixed limit (for example, 6A) and the switching transistor is maintained in the desaturated condition for a certain further period of time.

When the signal $V_{ip}$ indicates that the rate of rotation of the engine is greater than $n_0$, the current $I_{20}$ no longer varies as the rate of rotation varies and the desaturation time of the switching transistor 7 is always practically zero.

The system according to the invention thus ensures that the transistor has a desaturation time which is not zero at low rates of rotation of the engine and a desaturation time which is practically nil at high rates of rotation. At low rates, that is, at rates for which the relative variations from one period between two ignitions and the subsequent period may be very considerable, a sufficiently intense current in the primary winding of the ignition coil is thus ensured even during sharp accelerations. At high rotational rates, when the relative variations from one period between two ignitions and the subsequent period are modest, however, the dissipation of power by the transistor is drastically reduced even during acceleration.

Conveniently, the regulating circuit 23 of the dwell angle control circuit 13 may be arranged also to modify the intensity of the current from the generator 21 in a predetermined manner. This enables the decrement of the voltage $V_c$ during the discharge phases of the capacitor $C_2$ to be modified. This possibility enables the overall time for which the transistor is conductive to be varied and hence the final value achieved by the current in the primary winding of the ignition coil to be varied.

Naturally, the principle of the invention remaining the same, the forms of embodiment and details of construction may be varied widely with respect to that described and illustrated purely by way of non-limiting example, without thereby departing from the scope of the present invention.

We claim:

1. An electronic system for controlling the ignition of an internal combustion engine, comprising:

a magnetic pulse generator (1 to 3) for outputting a signal (A) having a frequency and amplitude substantially proportional to the rate of rotation (n) of the engine, an ignition coil (4 to 6) the secondary winding (6) of which can be coupled selectively and cyclically to the plugs (SP) of the engine to generate the spark, a switching transistor (7) connected to the primary winding (5) of the coil (4 to 6), and an electronic control circuit (8 to 34) which is connected to the pulse generator (1 to 3) and to the switching transistor (7) and which, in order to cause a spark to be generated, is arranged to cause a. the transistor (7) to become saturated at a first moment determined by the characteristics of the signal (A) from the pulse generator (1 to 3) to allow current to pass through the primary winding (5) of the ignition coil (4 to 6), b. the transistor (7) to be desaturated immediately the current (I) has reached a predetermined value in order to limit the intensity of the current, and c. the transistor (7) to be cut off at a second moment determined by the characteristics of the signal (A) from the pulse generator (1 to 3) to interrupt the current (I), characterized in that the control circuit (8 to 34) includes:

electrical sensor means (14) for providing a signal ($V_{ip}$) indicative of the rate of rotation of the engine, and a circuit ($C_2$, 20 to 23) for regulating the desaturation time of the transistor (7), coupled to the electrical sensor means (14) and arranged to control the time for which the transistor (7) is conductive so that the length of the desaturation time of the transistor (7) is substantially nil when the rate of rotation of the engine is greater than the predetermined value ($n_0$).

2. An electronic ignition control system according to claim 1, characterised in that the circuit for ($C_2$, 20 to 23) regulating the desaturation time is arranged to control the time for which the transistor (7) is conductive so that the period of time is a function of the decreasing desaturation and of the rate of rotation of the engine when the rate of rotation is less than the predetermined number ($N_0$).

3. Ignition control system according to claim 1, in which the control system comprises:

means (8) for sensing the current in the primary winding (5) of the ignition coil (4), circuit means for generating a reference voltage ($V_C$) across a capacitor ($C_2$), a comparator circuit (18) which outputs a command signal for rendering the transistor (7) conductive when a signal ($V_P$) formed from the signal from the pulse generator (A) exceeds the reference voltage ($V_C$), regulating circuit means (20 to 23) for raising and lowering the reference voltage ($V_C$) respectively, when the rate of rotation of the engine falls and increases respectively, and means (14 to 16) for monitoring the changes in the signal (A) usually supplied to them from the pulse generator, to generate corresponding signals for cutting off the transistors (7), characterised in that the first regulating circuits comprise:

first and second controlled current generator means (21, 20) for discharging and charging the capacitor ($C_2$) respectively, b. a control circuit (22) arranged to activate the first current generator means (21) to cause partial discharging of the capacitor ($C_2$) when the comparator circuit (18) outputs the control signal, to de-activate the first current generator means (21) and to activate the second generator means (20) to cause the recharging of the capacitor ($C_2$) when the current sensor means (8) indicate that the current in the primary winding (5) of the ignition coil (4) has reached a predetermined minimum level, and to de-activate the second current generator means (20) when the monitoring means (14 to 16) detect a mainly negative passage of the signals ($V_c$) of the pulse generator, and c. a control circuit (23) for modifying the intensity of the current generated by the first and/or second current monitoring means (21, 20) in a predetermined manner.

* * * * *